United States Patent [19]

DeVitis

[11] Patent Number: 4,766,634

[45] Date of Patent: Aug. 30, 1988

[54] RADIUS EDGER

[76] Inventor: Louis DeVitis, R.D. #1, Box 258-A, Hightstown, N.J. 08520

[21] Appl. No.: 140,558

[22] Filed: Jan. 4, 1988

[51] Int. Cl.[4] ..... B28B 17/00

[52] U.S. Cl. ..... 15/235.4; 15/235.7; 425/458

[58] Field of Search ..... 15/235.3–235.8, 15/105.5; 425/458

[56] References Cited

U.S. PATENT DOCUMENTS 2,730,756 1/1956 Greene ..... 425/458

3,045,271 7/1962 Cinotti ..... 15/235.8

*Primary Examiner*—Edward L. Roberts

*Attorney, Agent, or Firm*—Ira M. Adler

[57] ABSTRACT

A hand tool for forming the tight radius exterior corner of a cement surface. The tool which consists of a flat inflexible circular plate the circumference of which is curved upward, except for segment of which is curved downward in a spout-like manner. The length of the downward curved segment is such that the tool can be pivoted at the corner while allowing the mason to shape the exterior corner and maintain a smooth surface.

4 Claims, 2 Drawing Sheets

RADIUS EDGER

FIELD OF THE INVENTION

The invention relates to the construction arts and particularly to a hand tool to shape the tight radius exterior corner of a cement surface.

BACKGROUND OF THE INVENTION

When a mason is edging a cement surface and is required to turn a exterior corner having a tight radius, the mason is required to use tools designed for producing straight edges. A high degree of skill and experience is required to produce a smooth surface at the corner.

The object of my invention is to produce a hand tool which will allow the mason to edge exterior corners having a tight radius and a smooth surface, with a minimum of effort and skill.

SUMMARY OF THE INVENTION

The object of my invention are achieved by providing a hand tool having a flat circular shape, one portion of the edge extending outward and curving downward, the remainder of the edge curving upward.

DETAILED DESCRIPTION OF THE INVENTION

Figure 1:
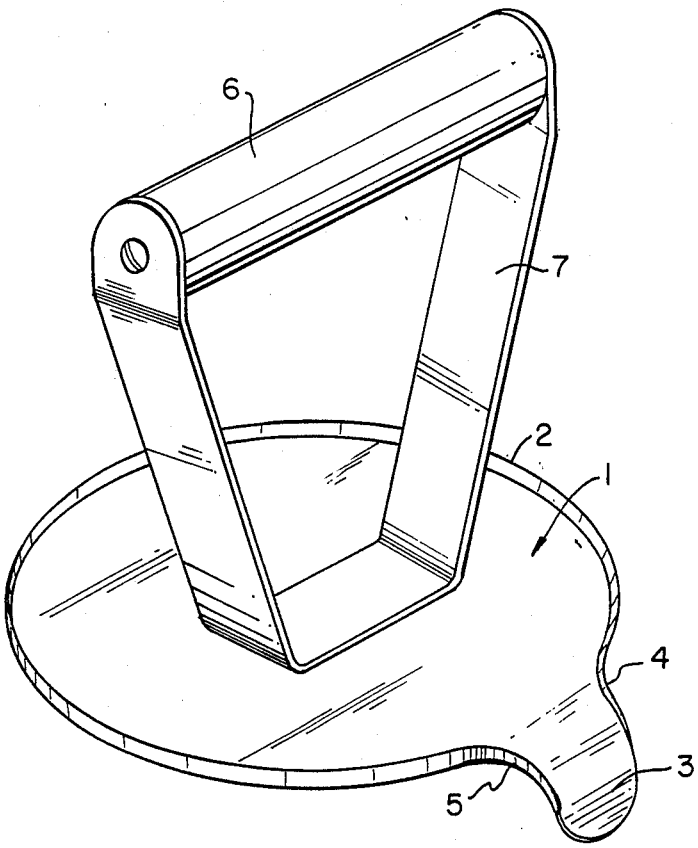
FIG. 1 is a perspective view of the invention.
Figure 2:
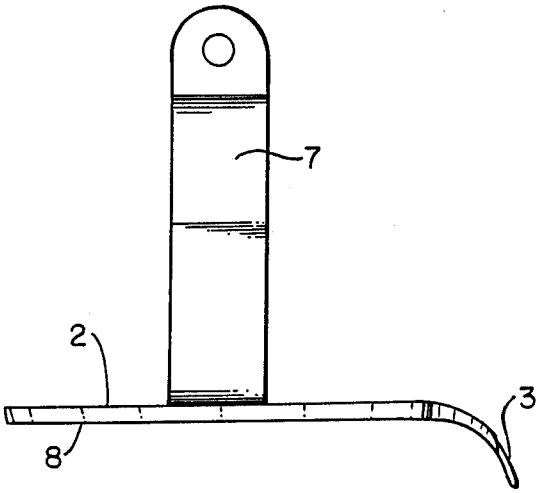
FIG. 2 is a side view.
Figure 3:
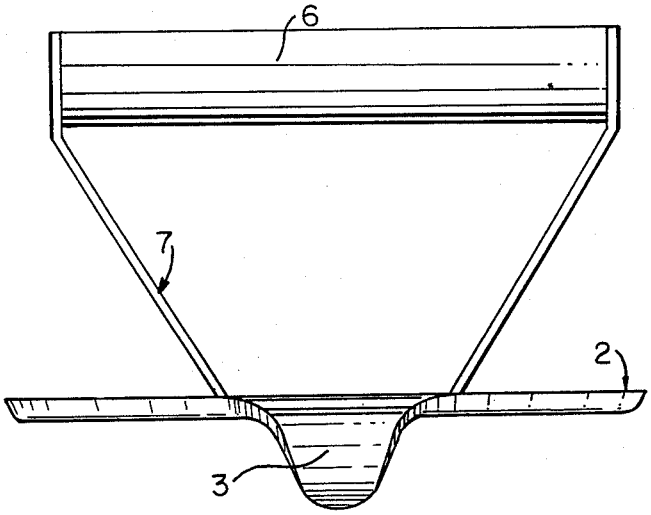
FIG. 3 is a front view.

The tool consists of two main elements: the first of which is a flat inflexible circular plate 1, having a smooth underside 8, the edge of said plate is circumferencely curved upward 2, in a coaster-like manner, except at one segment of the circumference 3 which extends outward from the edge and is curved downward, in a spout-like manner. To avoid the tool from cutting into the surface of the cement, the upward curving circumference is continuous only to the middle and on both sides of the spout, 4 and 5, gradually tapering off. The length of the downward curving segment is approximately 1", which is of such size as to allow the tool to pivot without distorting the curved exterior corner of the cement surface and still allowing a smooth cement surface, but may be somewhat greater or smaller depending on the diameter of the plate 1.

The second element of the tool is a handle 6, affixed to the plate by a suitable means 7.

Figure 4A:
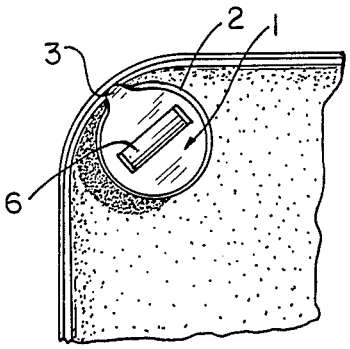
FIG. 4A is a top view of the tool illustrating the use of the tool at an exterior corner of a cement surface.
Figure 4B:
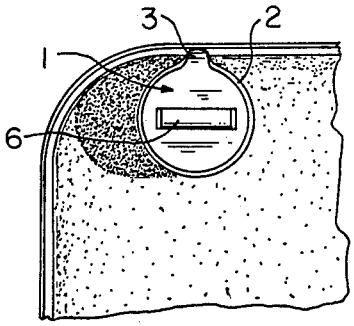
FIG. 4B is a top view of the tool in use as in 4A.

In use, the tool is held such that the spout, 3, forms the curved edge of the cement and the radius of plate, 1, which extends through the spout, 3, is perpendicular to the edge of the cement surface. The mason pivots the tool around the outside edge, and can easily maintain a uniform surface on the cement, as illustrated in FIGS. 4A and 4B.

I claim:

1. A hand tool for forming the exterior tight radius corner of a cementious material, comprising:

(a) a flat inflexible circular plate the edge of which is circumferencely curved upward, except for one segment of which is radially extended out from the edge and downward curved, said upwardly curved circumference gradually tapering-off until the middle of both sides of the downward curving extension;

(b) a handle; and (c) means for connecting said handle to the top of said plate.

2. The hand tool of claim 1 in which said plate is fabricated of 18 to 20 gauge sheet metal.

3. The hand tool of claim 1 in which said plate is formed of cast iron.

4. The hand tool of claim 1 in which said plate is formed of cast aluminum.

* * * * *